US005461402A

United States Patent [19]

Chow et al.

[11] Patent Number: 5,461,402

[45] Date of Patent: Oct. 24, 1995

[54] PINCH ROLLER FOR PEN PLOTTERS INCLUDING PLATEN BRIDGE TO PREVENT MEDIA SNAG

[75] Inventors: William C. Chow, West Covina; James Lawrence, Irvine, both of Calif.

[73] Assignee: Calcomp Inc., Anaheim, Calif.

[21] Appl. No.: 306,737

[22] Filed: Sep. 15, 1994

Related U.S. Application Data

[63] Continuation of Ser. No. 966,328, Oct. 26, 1992, abandoned.

[51] Int. Cl.[6] ..... B41J 13/00

[52] U.S. Cl. ..... 346/134; 346/139 R

[58] Field of Search ..... 347/104; 346/134, 346/139 R, 111, 112, 140.1; 33/18.1; 271/3, 272; 400/539, 642, 638, 644, 645, 645.3, 645.4

[56] References Cited

U.S. PATENT DOCUMENTS 5,235,353 8/1993 Hirano et al. ..... 346/134 X

*Primary Examiner*—Benjamin R. Fuller
*Assistant Examiner*—David Yockey
*Attorney, Agent, or Firm*—Wm. F. Porter, Jr.; Richard T. Lyon

[57] ABSTRACT

A support arm for use in a pen plotter having a platen with a platen extension in front of it spaced to provide a slot therebetween to rotatably support a pinch roller above the platen to prevent the edges of plotting media inserted between the platen and the pinch roller from entering the slot. The arm is slidably supported under the platen on one end and passes through the slot to rotatably support a pinch roller above the platen on the opposite end. The arm has a bridging finger extending horizontally in the slot from a point adjacent the opposite end towards the plotting media from a side edge thereof. Preferably, the bridging finger is of a width substantially equal to the width of the slot and has a top surface at the same level as a top surface of the platen.

4 Claims, 2 Drawing Sheets

PINCH ROLLER FOR PEN PLOTTERS INCLUDING PLATEN BRIDGE TO PREVENT MEDIA SNAG

This is a continuation of application Ser. No. 07/966,328 filed Oct. 26, 1992, now abandoned.

BACKGROUND OF THE INVENTION

This invention relates to pen plotters employing pinch roller holding media against a drive roller and, more particularly, to a support arm for use in a pen plotter having a platen with a platen extension in front of it spaced to provide a slot therebetween to rotatably support a pinch roller above the platen to prevent the edges of plotting media inserted between the platen and the pinch roller from entering the slot comprising, an arm slidably supported under the platen on one end and passing through the slot to rotatably support a pinch roller above the platen on an opposite end; and, a bridging finger extending from the arm horizontally in the slot from a point adjacent the opposite end towards the plotting media from a side edge thereof, the bridging finger being of a width substantially equal to the width of the slot and having a top surface at the same level as a top surface of the platen.

Early pen plotters had a flat plotting table upon which the plotting media was attached. A beam moved over the plotting media in one axis of the associated X–Y coordinate system while a plotting head moved over the beam in the other axis of the coordinate system. With large industrial sized drawings in particular, the plotter took up a lot of floor space. To eliminate the space in one direction, the roller type of drive depicted in FIG. 1 was adopted. The drawing instrument 10 as held by a plotting head (not shown) is moved on a beam (also not shown) over the plotting media 12 in one axis of the associated X–Y coordinate system as in the earlier table version. Rather than holding the plotting media 12 fixed, however, the plotting media 12 is moved under the drawing instrument 10 to create the movement in the other axis of the coordinate system. The plotting media 12 is supported by a short flat platen 14 with curved platen extensions 16 at the front and back to smoothly curve the plotting media 12 from a horizontal position adjacent the drawing instrument (where plotting takes place) to a vertical hanging position when away from the plotting position. The plotting media 12 is moved forward and backward over the platen 14 by a drive roller 18 under the plotting media 12. The plotting media 12 is held against the drive roller 18 by pinch roller 20 rolling over the top of the plotting media 12 at the edges thereof.

While early pen plotters constructed as in FIG. 1 supported the pinch rollers 20 from the top, later pen plotters adopted the approach shown in FIGS. 2–4 for simplification of the mounting apparatus. While the pinch rollers 20 are spring biased toward the drive roller 18 and can be lifted from the drive roller 18 against that bias to insert and remove the plotting media 12, that aspect is not depicted in the drawings in the interest of simplicity as it does not affect the point of novelty of the present invention. Thus, in such prior art pen plotters, the pinch rollers 20 are mounted on arms 22 that are slidably mounted on the bottom ends on a slide bar 24 carried by the plotter frame under the platen 14. The arms 22 pass through a slot 26 between the platen 14 and the front platen extension 16. While solving some problems, this prior art construction also created some new problems. For one, when inserting a new sheet of plotting media 12 into the plotter, it was quite easy to insert the sheet into the slot 26 instead of over the slot 26 and between the platen 14 and the pinch roller 20. To solve this problem, at least one manufacturer provided a series of raised fingers 28 also slidably mounted on the slide bar 24. The tops of the fingers 28 are at the same level as the platen 14. Thus, as the pinch rollers 20 are moved in and out from the sides to accommodate narrower and wider plotting media 12, the fingers 28 are also moved along the slot 26 as appropriate to provide support and guidance to prevent the media 12 from being inserted into the slot 26. As can be appreciated, such an approach merely adds to the complexity of the apparatus and to the complexity of adjusting the pen plotter for different sized plotting media 12.

Wherefore, it is the object of this invention to provide a pinch roller support construction for bottom mounting of the pinch roller wherein there is no need for the raised fingers 28 of the prior art to prevent the media 12 from being inserted into the slot 26.

Other objects and benefits of the invention will become apparent from the detailed description which follows hereinafter when taken in conjunction with the drawing figures which accompany it.

SUMMARY

The foregoing object has been achieved by the support arm of the present invention for use in a pen plotter having a platen with a platen extension in front of it spaced to provide a slot therebetween to rotatably support a pinch roller above the platen to prevent the edges of plotting media inserted between the platen and the pinch roller from entering the slot comprising, an arm slidably supported under the platen on one end and passing through the slot to rotatably support a pinch roller above the platen on an opposite end, the arm having a bridging finger extending horizontally in the slot from a point adjacent the opposite end towards the plotting media from a side edge thereof.

Preferably, the bridging finger is of a width substantially equal to the width of the slot. Also, the bridging finger has a top surface at the same level or slightly below the top surface of the platen. Additionally, the bridging finger extends a distance beyond the free end of the pinch roller into the slot sufficient to create an upward urging force on the edge of the printing media.

DESCRIPTION OF THE PREFERRED EMBODIMENT

Figure 1:
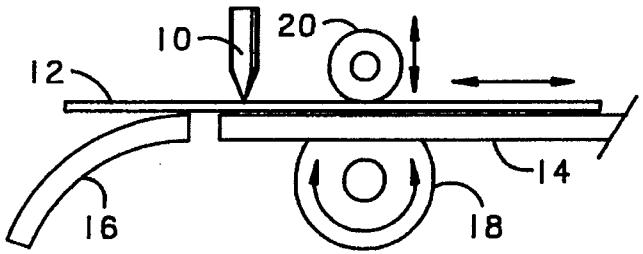
PRIOR ART FIG. 1
FIG. 1 is a simplified end view drawing of a drive roller, platen, platen extension, and pinch roller in a first prior art embodiment.
Figure 2:
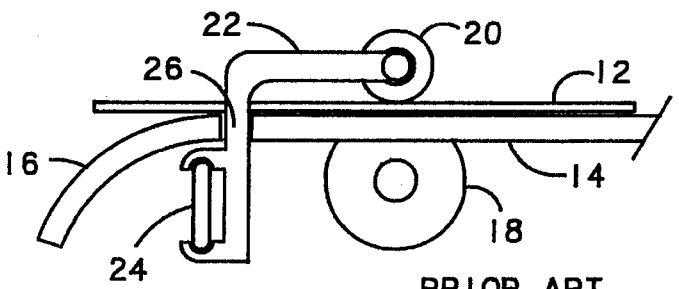
PRIOR ART FIG. 2
FIG. 2 is a simplified end view drawing of a drive roller, platen, platen extension, and pinch roller in a second prior art embodiment.
Figure 3:
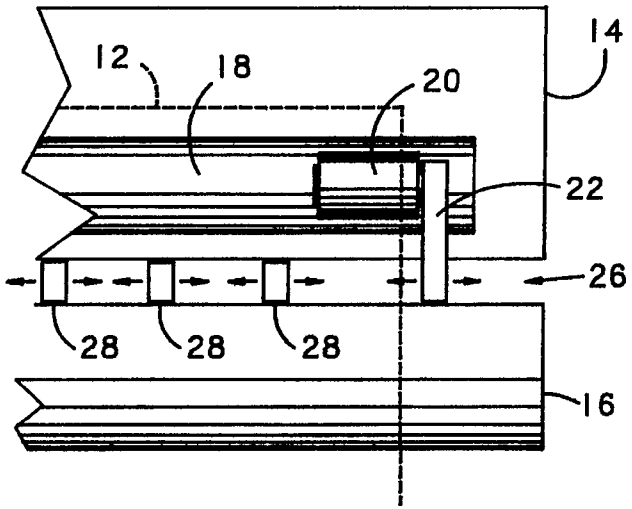
PRIOR ART FIG. 3
FIG. 3 is a top view of the apparatus of FIG. 2.
Figure 4:
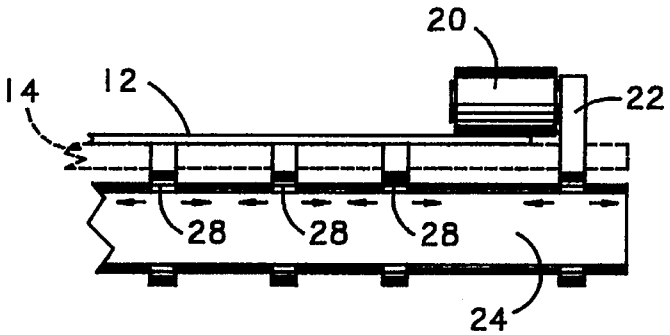
PRIOR ART FIG. 4
FIG. 4 is a front view of the apparatus of FIGS. 2.
Figure 5:
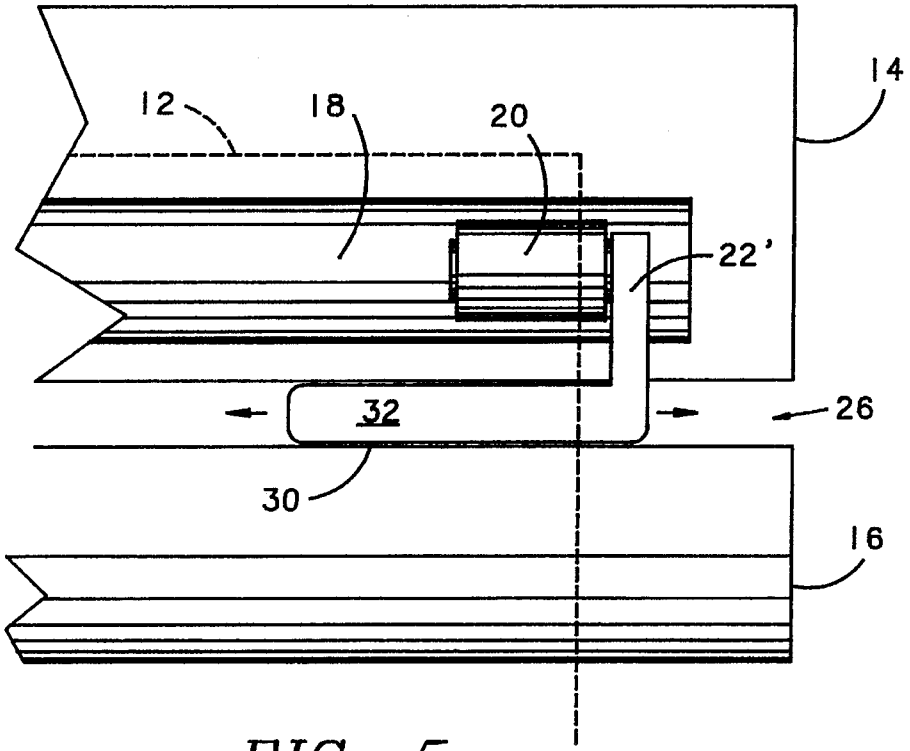
FIG. 5 is an enlarged simplified top view drawing of a drive roller, platen, platen extension, and pinch roller with platen bridge according to the present invention.
Figure 6:
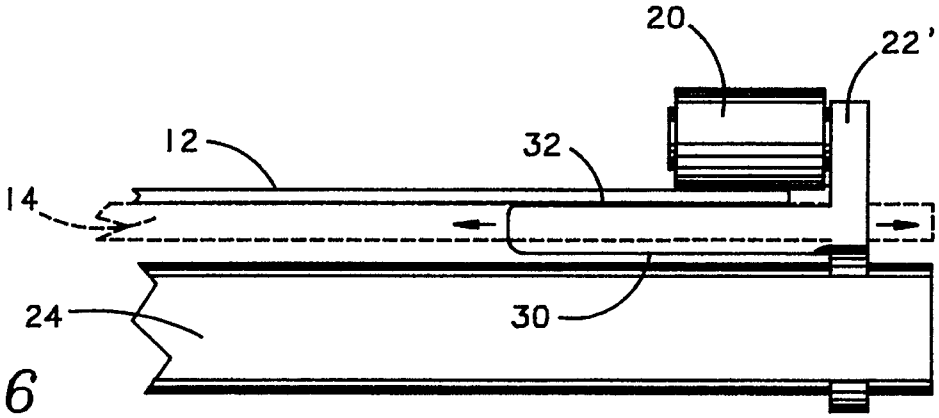
FIG. 6 is a front view of the apparatus of FIG. 5.

As depicted in FIGS. 5 and 6, the foregoing object has been achieved by adding a horizontally disposed bridging finger 30 extending outward from the pinch roller support arm 22'. The bridging fingers 30 extend inward from their respective support arms 22'. The right pinch roller 20 is depicted in FIGS. 5 and 6 and, as can be seen, the bridging finger 30 extends to the left from the support arm 22' thereof. The left pinch roller (not depicted) would be a mirror image so that the bridging finger 30 would extend to the right from the support arm 22' thereof.

As can be seen from the drawing figures, the bridging fingers 30 are of a width to fill the slot 26 and have a top surface 32 which is at substantially the same height as the top of the platen 14. Each bridging finger 30 is of a length which extends beyond the free end of the pinch roller 20 sufficiently to urge the plotting media 12 up and level With the top of the platen 14.

Thus, as can be seen and appreciated from the foregoing description and drawings, the present invention has met its stated object by providing a pinch roller support arm which both supports the pinch roller from a sliding mounting below the platen and bridges the slot adjacent the pinch roller to prevent the edges of the plotting media from entering the slot as the media is inserted into the plotter. Because the bridging fingers are incorporated into the pinch roller support arms, this bridging is automatic as the pinch roller is adjusted for different widths of plotting media and the requirement for the adjustable fingers of the prior art is eliminated.

Wherefore, having thus described the present invention, what is claimed is:

1. In a pen plotter having a platen with a platen extension disposed in front of the platen and spaced to provide a slot therebetween, and a support arm supported under the platen by a slide bar carried by a frame of the pen plotter and passing through the slot to, said support arm rotatably supporting a pinch roller above the platen, said pinch roller extending away from the support arm and towards plotting media inserted between the platen and the pinch roller, the improvement to prevent edges of the plotting media from entering the slot comprising:

a bridging finger attached to the support arm and cantilevered horizontally in the slot from the support arm towards the plotting media from a side edge thereof, thereby creating a one-piece support arm and bridging finger structure.

2. The improvement to a pen plotter of claim 1 wherein:

said bridging finger is of a width substantially equal to a width of the slot.

3. The improvement to a pen plotter of claim 1 wherein:

said bridging finger has a top surface substantially a same height as a top surface of the platen.

4. The improvement to a pen plotter of claim 1 wherein:

said bridging finger extends away from the support arm beyond a free end of the pinch roller.

* * * * *